US006648522B2

(12) United States Patent
Kolasinski et al.

(10) Patent No.: US 6,648,522 B2
(45) Date of Patent: Nov. 18, 2003

(54) FIBER OPTIC CONNECTOR POLISHING FIXTURE ASSEMBLY

(75) Inventors: John R. Kolasinski, Greenbelt, MD (US); Joseph Roch Moszcziewski, Titusville, FL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/804,646

(22) Filed: Mar. 13, 2001

(65) Prior Publication Data

US 2002/0131723 A1 Sep. 19, 2002

(51) Int. Cl.[7] ..... G02B 6/36
(52) U.S. Cl. ..... 385/85
(58) Field of Search ..... 385/85, 78, 77, 385/72, 60, 70, 53, 56, 139, 140, 79, 93, 88; 359/391, 393, 385

(56) References Cited

U.S. PATENT DOCUMENTS 4,757,194 A * 7/1988 Simms ..... 250/227
5,212,745 A * 5/1993 Miller ..... 385/25
5,235,153 A * 8/1993 Woelfl et al. ..... 219/121.66
5,937,122 A * 8/1999 Ohki et al. ..... 385/78
5,943,460 A * 8/1999 Mead et al. ..... 385/81
6,007,258 A * 12/1999 Marchitto et al. ..... 385/85
6,074,100 A * 6/2000 Rowland et al. ..... 385/78
6,162,112 A * 12/2000 Miyazaki et al. ..... 451/36
6,412,987 B1 * 7/2002 Horwitz et al. ..... 385/56

* cited by examiner

*Primary Examiner*—Jean F. Duverne
(74) *Attorney, Agent, or Firm*—Keith L. Dixon

(57) ABSTRACT

A fiber optic connector polishing fixture assembly for supporting a terminus of a fiber optic cable before a polishing surface. The assembly comprises: a fiber optic polishing fixture adapted to support the terminus before the polishing surface; a fixture support connected to the fixture for supporting the fixture before the polishing surface; and an adjustable connection between the fixture and the fixture support having user accessible adjustment controls for allowing a user to operate the controls to shift the fixture and fixture support relative to one another for substantially eliminating an apex offset of the terminus with respect to the polishing surface.

28 Claims, 7 Drawing Sheets

FIBER OPTIC CONNECTOR POLISHING FIXTURE ASSEMBLY

ORIGIN OF THE INVENTION

The invention described herein was made in the performance of work under a NASA contract and by an employee of the United States Government and is subject to the provisions of Section 305 of the National Aeronautics and Space Act of 1958, Public Law 85–568 (72 Stat. 435; 42 USC 2457), and may be manufactured and used by or for the Government for governmental purposes without the payment of any royalties thereon or therefor.

BACKGROUND OF THE INVENTION

1. Technical Field of the Invention

This invention generally relates to fiber optic connector polishing fixtures.

2. Description of Related Art

Fiber optic cables are increasingly being used for communicating wide bandwidths of data at high data transmission rates. The use of fiber optics typically becomes cost efficient as compared, for instance, to copper cables, when the data rates exceed about 100,000 bits per second (bps). The applications for fiber optic cables vary widely, from telecommunications, to cable television, to highly advanced aircraft and spacecraft systems. With the increased trend to automate the manufacturing of fiber optic cables and with diminishing material costs, the use of fiber optics is apt to become more widespread in arenas with less demanding telecommunications requirements, such as, for example, in many automotive applications. The use of fiber optic cables is advantageous in many respects. Fiber optic cables have a low weight, a low material cost, and are of a much smaller size as compared with conventional twisted-shielded pairs of copper wires.

Despite the above advantages of fiber optic cables, and many more not mentioned above, the manufacturing of the cables to required standards, and in particular with respect to fiber optic termini, presents problems for a number of reasons. One of these problems is related to the precision with which the terminus of a fiber optic cable is polished. The "terminus" in the context of the instant description refers to a combination of a rigid ferrule and of a fiber optic filament concentrically supported therein. It is well known that one of the preparation steps of a fiber optic cable involves the polishing of its terminus. Most fiber optic assemblies are fabricated by bonding a connector, including its ferrule, to an optical fiber. After this bonding step, excess fiber optic filament protruding from the exposed end of the connector ferrule is cleaved in preparation for polishing.

Generally, a coarse hand polish is performed on the terminus, such as, for instance, by holding the terminus in a puck and by moving it over a polishing surface. The coarse polish is then followed by a fine polish performed also by hand or with a machine. Conventionally, the ferrule of the terminus is polished such that it presents a convex end face, the apex of which must ideally be intersected by the centerline of the fiber optic filament. Any offset of the apex of the polished end face of the ferrule with respect to the centerline of the fiber optic filament, hereinafter referred to as "apex offset," affects the efficiency of spectral transmission between pairs of fiber optic cable termini placed face to face with respect to one another for transmitting data therebetween. In advanced fiber optic system designs, precision polishing is required due to stricter connector polishing requirements now being imposed. Polish parameters such as fiber protrusion and apex offset are now being required to meet submicron/micron level specifications. Apex offset, which must be less than 50 microns, is presently one of the difficult parameters to achieve with consistency.

It is clear that the use of hand-only polishing methods for fiber optic termini leaves much to be desired in the way of minimizing apex offset. Hand polishing involves the use of pucks, or fixtures, which offer only imprecise control of the terminus. Additionally, differences among human operators result in wide ranging variations between polished termini. As a result, machine polishing is becoming the technique of choice in the fabrication of fiber optic assemblies.

Machines do offer more consistent control, uniformity from one polished terminus to the next, increased productivity, and flexibility between multi-connector and single-connector polishing techniques and fixtures. However, existing machine polishing techniques, to the extent that they contemplate apex offset in the first instance, merely involve the use of machines designed with factory-only apex offset adjustments. Typically, a fiber optic polishing fixture, that is, a puck designed to hold and stabilize a fiber optic ferrule and/or connector in place with respect to a polishing surface during the polishing process, is manufactured taking into consideration machining tolerances to account for a possible apex offset as a function of those tolerances. It is well known that apex offset may be minimized among other things by achieving a high degree of orthogonality of the terminus centerline with respect to the polishing surface. Machining tolerances are taken into consideration with the aim of achieving a desired level of orthogonality.

Factory-only adjustment schemes however are inherently inflexible, as suggested above, mainly because they cannot take into consideration actual variations of terminus orientation with respect to the polishing surface "on-site," that is, at the time and place when a user is actually ready to start polishing or is polishing the terminus. Other variations include differences caused by materials such as rubber or resilient pads, abrasive films and lubricants used in the polishing processes. Such variations occur for many reasons, such as, for example, by virtue of the use of upgraded, changed or new connectors on the market, or by virtue of changing the polishing machine or the polishing process, or by virtue of changing the polishing disk. Shimming, or using a shim to prop the terminus into a desired orientation with respect to the polishing surface, is one way to compensate for the above problems. However, shimming does so only very crudely and inefficiently. Although shims for the purpose of allowing apex offset adjustment may be available on the market, they come only in discrete sizes, in this way limiting adjustment possibilities. Theoretically, an infinite range of shim sizes would have to be available to account for every apex offset possibility. Additionally, the shims tend to be compressed in the adjustment process, in this way deforming and leading to unpredictable results in the compensation of apex offset.

Moreover, existing polishing fixtures are typically capable of holding a single type of connector, such that, when new connectors come on the market, new fixtures must be manufactured to accommodate the same. Conventional fixtures involve the actual fixing of the connector to its respective fixture, for example by screwing one into the other, thus limiting the fixture to the screw size used for a specific type of connector. The time and cost for developing new polishing fixtures to accommodate new connectors are usually quite high. Long lead times for such fixtures can have adverse effects on project schedules, not to mention on the cost of the project.

Accordingly, a fiber optic connector polishing fixture is needed that is capable of allowing a simple and effective on-site apex offset adjustment. Additionally, a fiber optic connector polishing fixture that is universal, that is, a polishing fixture configured for supporting fiber optic connectors of varying configurations and diameters would be desirable.

SUMMARY OF THE INVENTION

In accordance with the invention, a fiber optic connector polishing fixture assembly for supporting a terminus of a fiber optic cable before a polishing surface is provided. The assembly comprises: a fiber optic polishing fixture adapted to support the terminus before the polishing surface; a fixture support connected to the fixture for supporting the fixture before the polishing surface; and an adjustable connection between the fixture and the fixture support having user accessible adjustment controls for allowing a user to operate the controls to shift the fixture and fixture support relative to one another for substantially eliminating an apex offset of the terminus with respect to the polishing surface.

Preferably, the adjustable connection comprises a set of three adjustment elements including a first adjustment element, a second adjustment element, and a third adjustment element, the adjustment elements being disposed with respect to one another such that, in a cross-sectional plane through the adjustment elements substantially parallel to the fixture support, points corresponding to respective centerlines of the three adjustment elements are not aligned. The first adjustment element is actuatable for effecting a change in the distance between the fixture and the fixture support at a location of the first adjustment element; and the second adjustment element is actuatable for effecting a change in the distance between the fixture and the fixture support at a location of the second adjustment element, an actuation of at least one of the first adjustment element and the second adjustment element effecting a pivoting adjustment of the fixture with respect to the fixture support for substantially eliminating an apex offset of the terminus with respect to the polishing surface.

The assembly herein described allows a user to make precision adjustments to minimize or substantially eliminate measured apex offset in the connector terminus to be polished. In the preferred form, the assembly has a fixture for supporting the terminus and a fixture support for supporting the fixture, and utilizes adjustment screws that allow a user to shift the fixture and the fixture support relative to each other in a precise predetermined manner to substantially eliminate the measured apex offset of the terminus to within the strict specifications mandated for many fiber optic applications. Three adjustment screws may be provided extending between the fixture and fixture support so that turning one of the screws causes pivoting of the fixture about an axis defined by the other two screws. The pivoting of the fixture pivots the connector terminus in relation to the polishing surface so that there is a component of movement of the terminus relative to the polishing surface in two directions perpendicular to one another. Thus, the measured apex offset can be addressed by either turning one screw where the offset from a reference point is only along one of the axes defined by the other two screws, or, as will more likely be the case, by turning both screws where the offset is along both such axes to effect the desired centering of the fiber optic terminus with respect to the polishing surface.

Additionally, the invention provides a method of adjusting apex offset using the assembly described above comprising the steps of: securely fastening the terminus within the terminus support profile of the fixture; moving the three adjustment elements into respective predetermined reference positions; polishing the terminus thereby forming a polished terminus; determining an apex offset of the polished terminus; and actuating at least one of the first adjustment element and the second adjustment element for effecting a pivoting adjustment of the fixture with respect to the fixture support for substantially eliminating an apex offset of the terminus with respect to the polishing surface.

In another form of the present invention, a fiber optic polishing fixture assembly for supporting a terminus of a fiber optic cable before a polishing surface is provided, the assembly including: a fiber optic polishing fixture defining a terminus support profile for supporting the terminus before the polishing surface; a fixture support connected to the fixture for supporting the fixture before the polishing surface; and means for changing a distance between the fixture and the fixture support at at least two point locations for effecting a pivoting adjustment about a third point location of the fixture with respect to the fixture support for substantially eliminating an apex offset of the terminus with respect to the polishing surface.

The invention further provides an assembly as described in the second paragraph of this section, wherein the fixture comprises a jaw movable between an open position and a closed position for securely clamping the terminus therein during a polishing thereof by the polishing surface, and wherein the fixture comprises: a top portion corresponding to a top portion of the jaw; and a bottom portion slidably connected to the top portion. Additionally, the terminus support profile of the fixture includes: a v-groove defined in the bottom portion of the fixture and adapted to receive the terminus therein; a first semicircular recess defined in the top portion; and a second semicircular recess defined in the bottom portion such that, in a closed position of the jaw, the first semicircular recess and the second semicircular recess are joined to define a counterbore framing the v-groove substantially at a center region thereof. The counterbore has a diameter of about 0.50 inch and the v-groove has a depth of about 0.06 inch. The above configuration of the fixture advantageously allows it to be used with connectors having a wide range of diameters.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
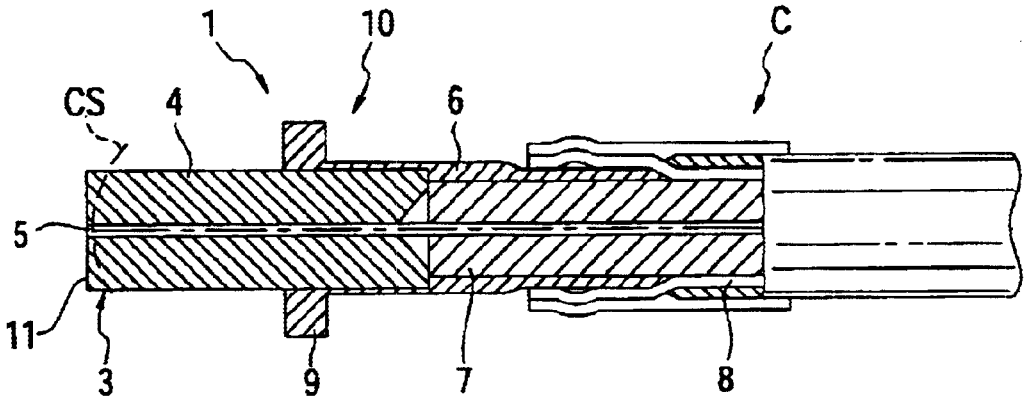
FIG. 1 is a partially cross-sectional view of a known fiber optic polishing fixture assembly with an unpolished terminus.

Turning now to the drawings and more particularly, to FIG. 1, a conventional fiber optic cable assembly 1 is shown including a fiber optic cable C and a fiber optic terminus 3 at an end portion thereof. Fiber optic cable C can have a centrally extending fiber optic filament 5, an inner jacket 7 extending thereabout, and outer protective sleeves 8 surrounding the jacket. The terminus 3 is representative of termini ready to be polished for use in establishing a connection between pairs of fiber optic cables, the polished termini being typically aligned face to face by means of a conventional pin or socket arrangement. In the context of the present description, a fiber optic terminus comprises at least the combination of a fiber optic filament such as filament 5, which, as is well known, is a glass filament typically having a diameter of 125 microns, although it can have a diameter anywhere between 50 and 500 microns, together with a rigid structure known as a ferrule, such as ferrule 4. Ferrules are usually made of a ceramic material such as zirconia or alumina for ensuring their stability through a wide range of temperature changes and for ensuring their ability to be machined with precision. Before the polishing process, the end of glass filament 5 protrudes slightly beyond external end face surface 11 of ferrule 4, usually in the order of about 0.5 mm as shown in FIG. 1, but it could protrude more or less depending on operator cleaving ability. After the polishing process, however, the end of glass filament 5 is flush with external face surface 11, and the terminus preferably has a convex end profile, as shown in broken lines CS in FIG. 1. Fiber optic assembly 1 is an example of the kind of fiber optic assembly that is apt to be polished using the polishing fixture according to the present invention.

As is well known, each terminus must be polished according to highly precise specifications to optimize the spectral transmission between pairs of simplex cable assemblies. The rate of spectral transmission is among other things a function of the apex offset of the filament with respect to the ferrule, as large apex offsets can result in optical reflections in a terminus—terminus connection causing data errors. According to the instant invention, a fiber optic connector polishing fixture is provided that allows on-site apex offset adjustment according to a three-point pivoting scheme for establishing substantial orthogonality between a centerline of the fiber optic filament and a polishing surface.

Figure 2A:
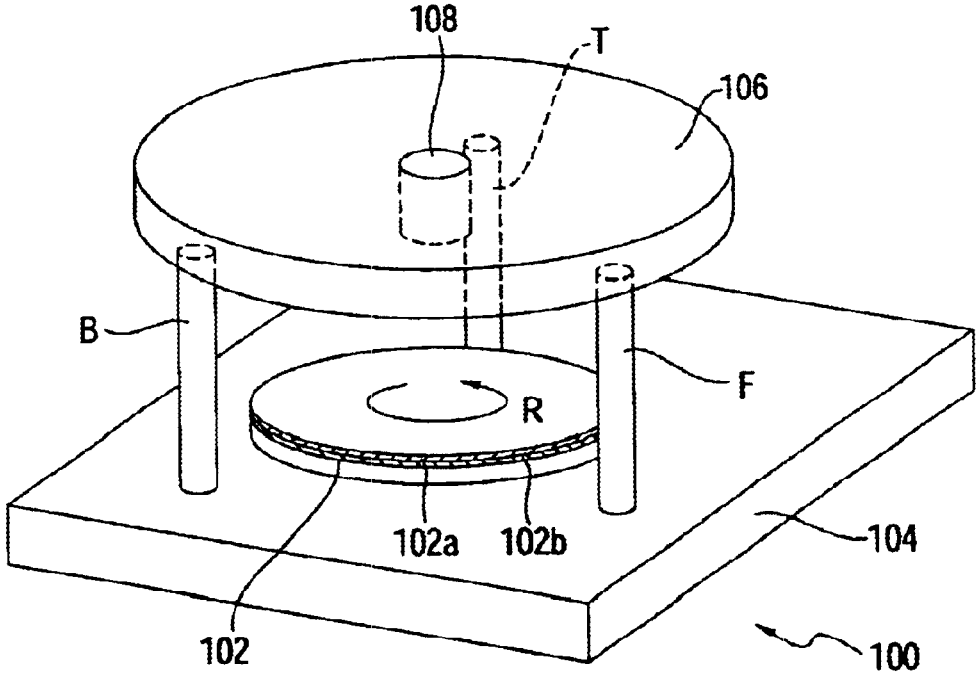
FIG. 2*a* is a schematic perspective view of an embodiment of a fiber optic connector polishing fixture assembly according to the present invention.

One principle of the invention involves the prevision adjustment of a fixture for a fiber optic connector with respect to the polishing surface. This may be understood with respect to a simplified depiction of one form of the invention including the fiber optic connector polishing fixture assembly as shown in FIG. 2*a*. As seen in FIG. 2*a*, a polishing apparatus 100 is provided comprising a polishing disk 102 supported on a polishing support structure 104. The disk is rotatable in the direction of arrow R or possibly in a random orbital motion for polishing a fiber optic terminus exposed thereto. A fiber optic connector fixture 106 is supported above fixture support 104 by way of three adjustment elements B, F and T, and further defines therein a terminus support profile in the form of bore 108 for supporting a terminus of a fiber optic connector therein during a polishing operation of the terminus by the polishing disk 102. While a single bore 108 is shown, fixture 106 may define a plurality of similar bores or one or a plurality of other terminus support configurations for supporting one or more termini above disk 102 during a polishing thereof. While, during a polishing of the terminus, support structure 104 and fixture 106 remain substantially fixed with respect to one another, polishing disk 102 presents a floating surface relative to the terminus being polished. In this respect, as seen in FIG. 2*a*, disk 102 includes at a top region thereof a resilient rubber layer or pad 102*b* covered by a polishing layer 102*a*, such as one made of silicon carbide, diamond or aluminum oxide. Typically, layer 102*b* has a thickness of about ⅛ inch, and layer 102*a* a thickness of about 3 mm. During polishing, the terminus is secured in bore 108, and its end pressed onto disk 102. Pressure thus applied by the end of the terminus onto the polishing disk creates a depression in layers 102*a* and 102*b* by virtue of the resilience thereof. This depression causes the terminus end to assume a convex shape after polishing, as is well known in the art.

The polishing apparatus shown in FIG. 2*a* utilizes a three-point pivoting scheme in the form of adjustment elements B, F and T. In contrast, polishing apparatuses of the prior art would involve a four point support system for the support of the fixture on the support surface 104. As previously noted, such a four point support system only allows for adjustment of the apex offset by way of a factory-only adjustment scheme or through shimming. However, according to the present invention, adjustment elements B, F and T are configured such that an actuation of one of the adjustment elements effects a predetermined change in the distance between the fixture and its support surface at the location of said one of the adjustment elements for effecting a pivoting of the fixture about an axis defined by the other two of the adjustment elements. The above principle can be more clearly understood with reference to FIG. 2*b*. It is noted that, in the context of the present description, a change in distance at the "location" of an adjustment element corresponds to a change in distance substantially along the centerline of the adjustment element. Moreover, "fixture" is to be broadly understood to refer to a structure of a fiber optic connector polishing fixture assembly for supporting or holding a terminus before the polishing surface of a polishing machine, and "fixture support" is to be broadly understood as a structure of the assembly for supporting the fixture before the polishing surface.

Figure 2B:
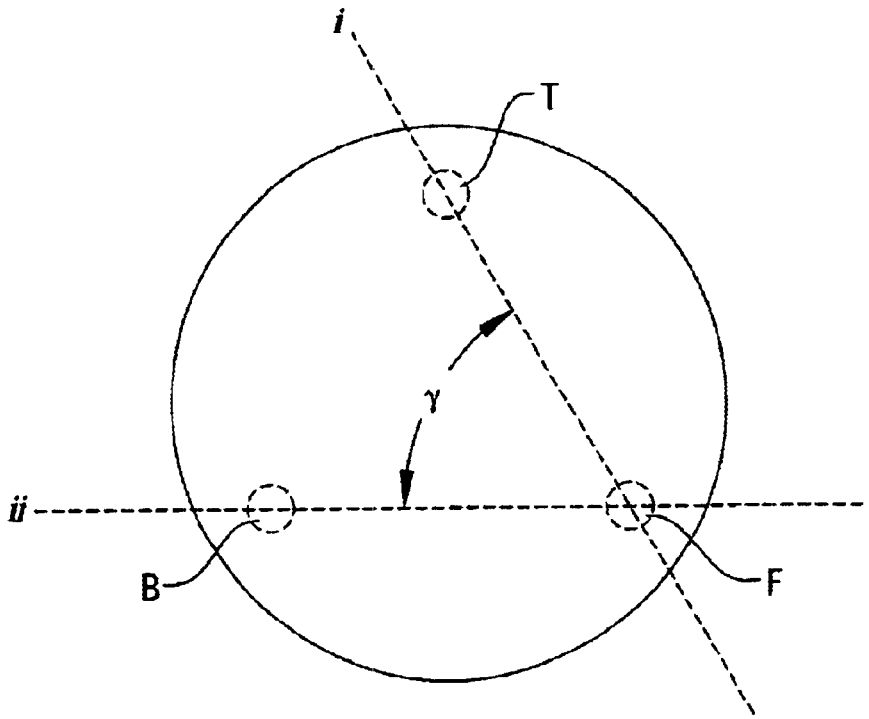
FIG. 2*b* is a top plan view of the assembly shown in FIG. 2*a;*

Referring now to FIG. 2*b*, a top plan view of fixture 106 is provided showing the location of adjustment elements B, F and T in broken lines. FIG. 2*b* among other things shows that, according to the present invention, in a cross-sectional plane through the adjustment elements substantially parallel to the fixture support, points corresponding to respective centerlines of the three adjustment elements are not aligned. In the embodiment of the present invention shown in FIGS. 2*a* and 2*b*, an actuation of adjustment element B would change the distance between fixture 106 and support 104 at the location of adjustment element B, thereby effecting a pivoting of the fixture about axis i through adjustment elements F and T. Similarly, an actuation of adjustment element T would change the distance between fixture 106 and support 104 at the location of adjustment element T thereby effecting a pivoting of the fixture about axis ii through adjustment elements B and F. Preferably, adjustment element F is fixed, that is, it provides a reference offset position for the actuation of adjustment elements B and T.

Angle γ between the two pivoting axes i and ii is shown in FIG. 2*b* as being about 120 degrees. However, the present invention is not limited to the stated angle between axes i and ii. The determination of angle γ depends among other things on application needs and/or on the method for determining apex offset, as will be described in more detail below. By way of example, according to a preferred form of the invention where angle γ is 90 degrees, it becomes easier to calculate the adjustment of a terminus with respect to a polishing surface by virtue of actuating adjustment elements B and T with respect to fixed adjustment element F. Assuming that (1) γ is 90 degrees, (2) axis i is the y axis, (3) axis ii is the x axis, (4) P is the distance by which the terminus projects beyond the surface of the fixture facing the polishing surface, (5) $d_{Ft}$ is the distance between F and the terminus centerline; then, the change in the distance between the fixture and its support at the location of adjustment element B, that is, $\Delta_B$, may be readily determined by one skilled in the art using the following values: (1) Δx as the desired adjustment of the terminus against the polishing surface in the x direction; and (2) $d_{BF}$ as the distance between adjustment elements B and F. Similarly, the change in the distance between the fixture and its support at the location of adjustment element T, that is, $\Delta_T$, may be readily determined by one skilled in the art using the following values: (1) Δy as the desired adjustment of the terminus against the polishing surface in the y direction; and (2) $d_{TF}$ as the distance between adjustment elements T and F.

While FIG. 2*a* shows adjustment elements as supporting the fixture on the same support as that provided for the polishing disk, the present invention encompasses a configuration where the adjustment elements support the fixture on a support surface facing the polishing disk, and as shown in detail with respect to a preferred embodiment of the present invention in FIGS. 3 through 7*c* and described in further detail below. Additionally, adjustment elements B, F and T may have any configuration that allows them to effect a change in distance between the fixture and the support for the fixture. Preferably, adjustment elements comprise screws, the use of screws being advantageous in that it allows a simplified determination of either $\Delta_B$ or $\Delta_T$ based on the number of threads per inch on the screws being used, and the number of turns of the screw effected to actuate the pertinent adjustment element B or T. Thus, the screws may be adjusted in or out some fraction of a turn depending on the magnitude and direction of the x and y components of the apex offset. The third screw, that is, screw F, would act as a reference pin and a pivot, and would therefore not be actuated. In an alternative embodiment of the invention, F may be a ball joint or a fixed rod.

In order to determine whether and to what extent apex offset exists in a given orientation of a fixture, various conventional methods may be used. One such method involves the use of interferometry, which, as recognized by one skilled in the art, encompasses the use of an interferometer to measure apex offset. Interferometry is best suited for determining apex offset where B, F and T are disposed such that angle γ between axes i and ii is 90 degrees. The thus determined apex offset may, according to the present invention, be then broken down into its x and y components, and $\Delta_B$ and $\Delta_T$ determined as noted above for adjusting the fixture with respect to the polishing surface thus substantially eliminating the apex offset. In the alternative, and especially where the breaking down of apex offset into its x and y components may not allow a simple determination of the actuation amount of adjustment elements B and T for eliminating apex offset in the x and y dimensions, it is possible to use a laser reflection method.

According to the laser reflection method, a pre-polished cable having a connector at either end thereof is placed in the fixture at one end thereof and clamped therein facing the polishing surface at a pre-set distance, preferably at about 50/1000 inch. The other end of the cable is connected to a conventional laser detector system. Adjustment elements B and T are then adjusted to provide a maximum laser signal by the laser detection system, thereby indicating orthogonality and a substantial elimination of apex offset. According to one embodiment, a mirror or other reflective layer could be placed on the polishing surface in order to enhance a reflection of the laser beam.

Figure 2C:
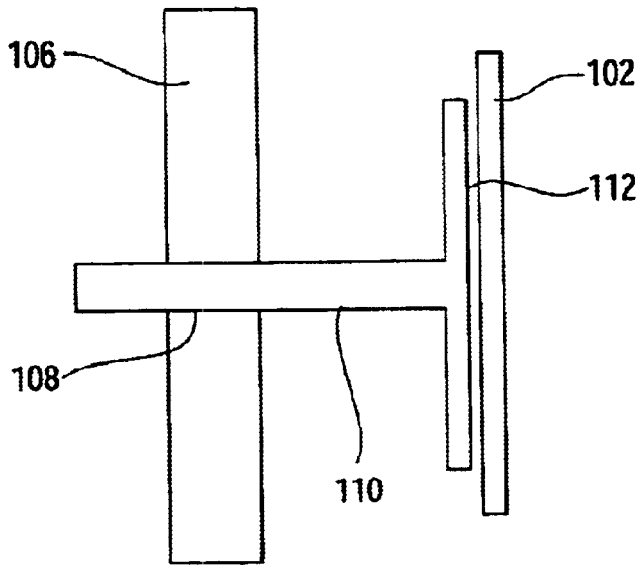
FIG. 2*c* is a side elevational view of an adjustment puck used in the assembly shown in FIG. 2*a;*

Another alternative would be the use of an alignment puck, such as, for example, alignment puck 110 shown in FIG. 2*c*. The alignment puck presents a flat surface 112 with respect to polishing disk 102 when supported by fixture 106 as seen in FIG. 2*c*. Here, adjustment elements B and T may be actuated such that the flat surface 112 is substantially parallel with the polishing surface of polishing disk 102, for example by simply eye-balling surface 112 with respect to the polishing disk during the adjustment process. Similar to the laser reflection method described above, the alignment puck method is also especially suited to embodiments of the invention where B, F and T are not necessarily disposed such that axes i and ii are perpendicular with respect to one another.

After actuation of adjustment elements B and T for eliminating apex offset as described above, it is advantageously possible, according to the present invention, to maintain the fixture in the adjusted position with respect to the polishing surface. Once the fixture is aligned and locked in place, it would not require further adjustment unless the interface arm is transferred to a different polishing machine, or unless the polishing process is changed, or a different polishing disk or platen is used. In this way, an unlimited number of connectors may be polished without further realignment.

The general principle of the present invention having been described with respect to the embodiment shown in FIGS. 2*a* through FIG. 2*c*, a preferred embodiment of the present invention is described in detail below with respect to FIGS. 3 through 7*c*.

Figure 3:
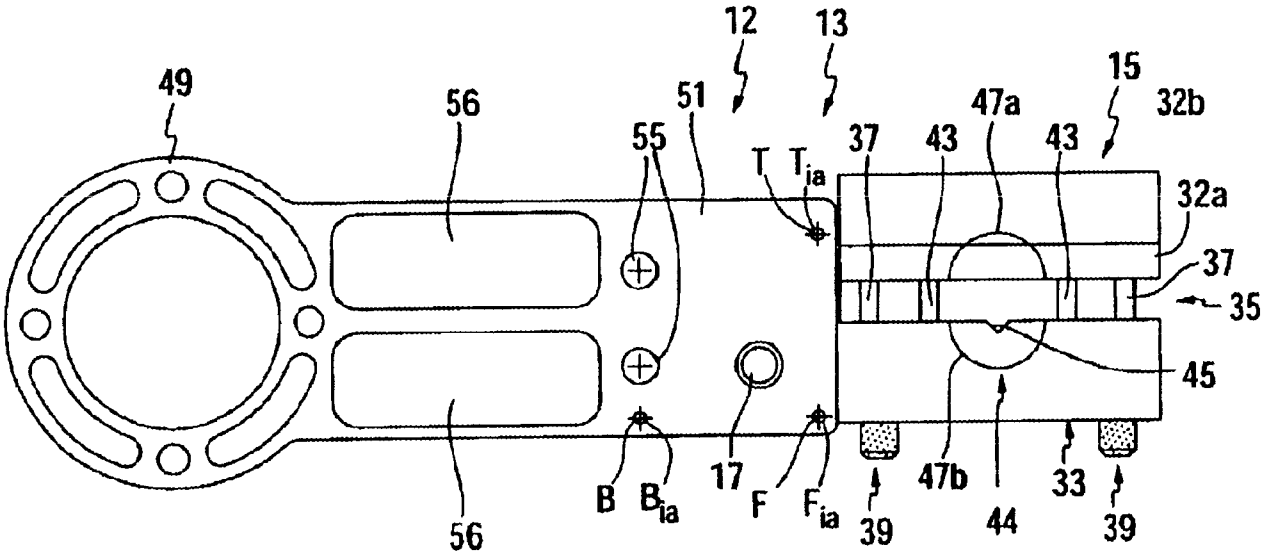
FIG. 3 is a front elevational view of a fiber optic connector polishing fixture assembly according to a preferred embodiment of the present invention seen from its insertion side.
Figure 5:
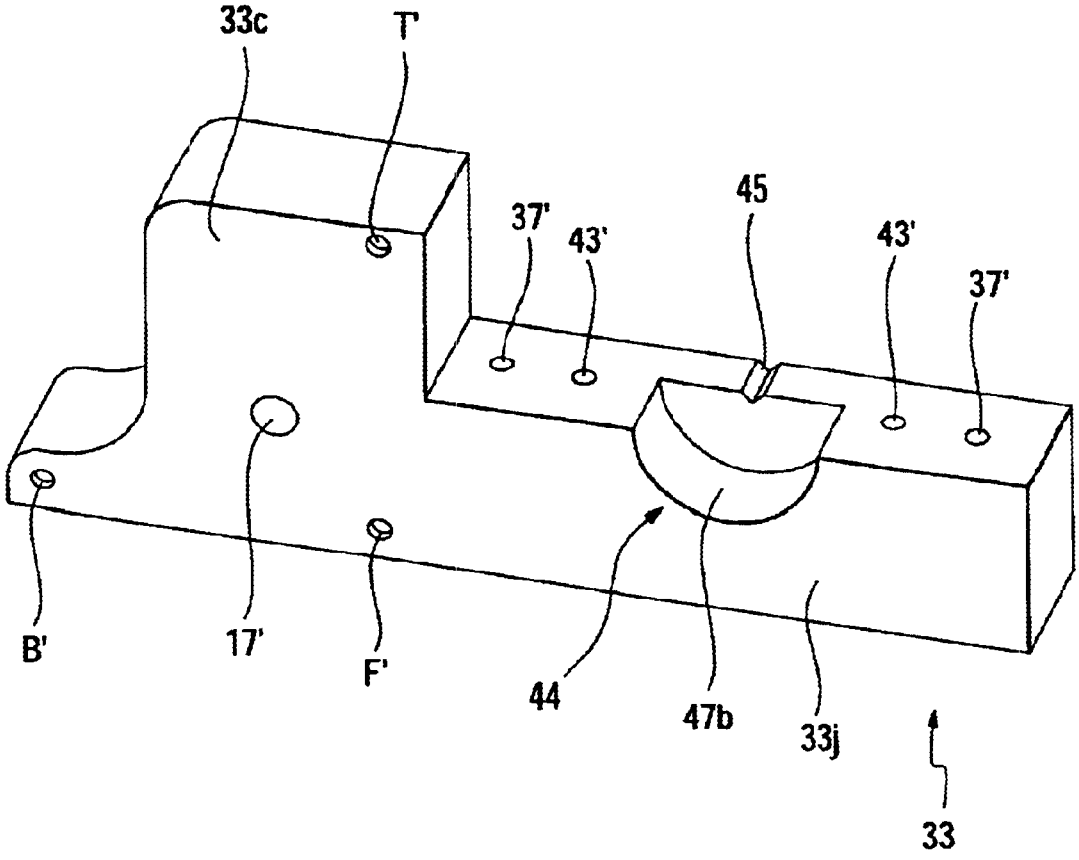
FIG. 5 is a perspective view of the bottom portion of the fixture of the assembly shown in FIG. 3.

As seen in particular in FIG. 3, a fiber optic connector polishing fixture assembly 12 according to a preferred embodiment of the invention includes a machine interface arm portion or interface arm 13 and a connector fixture portion or fixture 15 connected to interface arm 13. In this embodiment, interface arm serves as the support for the fixture, and fixture 15 is configured for supporting a terminus of a fiber optic cable during polishing. Additionally, interface arm 13 connects to the polishing arm of a polishing machine. As seen in FIG. 3, adjustment elements B, F and T allow the pivoting adjustment of fixture 15 with respect to its support, that is, the interface arm 13. To allow this pivoting adjustment and still maintain a connection between interface arm 13 and fixture 15, a compliant preload mechanism 17 is preferably provided. The compliant preload connects the fixture to its support, while the adjustment elements allow an adjustment of the orientation of the fixture with respect to its support.

Figure 4:
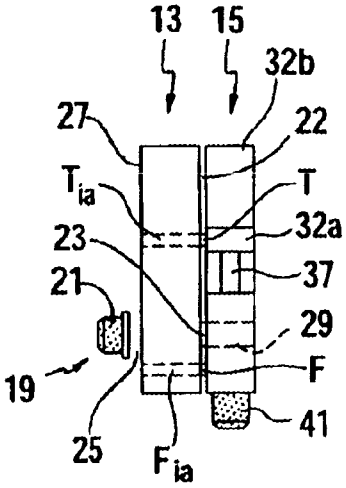
FIG. 4 is a side elevational view of the assembly shown in FIG. 3.

In the shown embodiment as seen in better detail in FIG. 4, preload mechanism comprises a bolt 19 having a head 21 and a threaded body or shank 23, together with a compression spring 25. Spring 25 is mounted about the bolt shank 23 and rests at one end thereof against an inner face of head 21 of bolt 19, and at its other end against an outer surface 27 of interface arm 13. Bolt 19 is received in a corresponding threaded bore 29 defined in fixture 15. Compliant preload mechanism 17 holds interface arm 13 and fixture 15 together during and after an adjustment operation to shift the aim and fixture with respect to one another, the mechanism biasing arm portion 13 and fixture 15 toward one another and making possible a pivoting of fixture 15 with respect to the interface arm by virtue of an actuation of adjustment elements B, F and T, as described with respect to FIGS. 2*a* through 2*c* above, and as will be described in further detail below. The compliant preload mechanism 17 will be loosened during adjustment, and tightened after adjustment is complete, so that spring 25 is fully compressed so that there is no preloading after adjustment.

Fixture 15 includes a top portion 31 and a bottom portion 33, the top and bottom portions defining a jaw 35 adapted to support or to fixedly hold or clamp in position a fiber optic connector during a polishing of the terminus. While, in the instant description, the two main jaw parts of jaw 35 are referred to as a "top" and a "bottom" portion, it is to be understood that references to "top" and "bottom" have been made herein merely to differentiate between the two jaw parts, and are by no means meant to unite the jaw portions to the mentioned physical orientations thereof. Top portion 31 in turn preferably comprises a soft-jaw portion 32*a* made of a compliant or resilient material having reasonable wearability, such as, for example, DELRIN®, a machinable polytetrafluoroethylene-based product manufactured by E. I. du Pont de Nemours and Company. Top portion 31 further includes a rigid jaw portion 32*b* that is secured to soft-jaw portion 32*a* by conventional means such as pins and/or bolts. The use of a soft jaw portion advantageously minimizes damage to the terminus as by scratching and/or cracking of a terminus while the corresponding fiber optic connector is being supported in the fixture during the polishing process. While soft jaw 32*a* is preferably of a polytetrafluoroethylene material, the rest of the fixture assembly 12 is preferably of a non-corrosive stainless steel. The use of a non-corrosive material advantageously prevents damage when polishing slurries, water or other fluids are used for polishing the terminus. Additionally, the use of stainless steel allows the fixture assembly to hold alignment over a long period of time, in contrast to fixture assemblies constructed of soft materials such as aluminum or plastic, that may wear out quickly and/or change alignment.

In FIG. 3, the jaw is shown in its open position, and reveals threaded body or shank portions 37 of a pair of bolts 39 each further having a head portion 41. Bolts 39 hold the top portion 31 and bottom portion 33 in alignment with one another when the jaw 35 is in its open position, and are further adapted to tighten to clamp the jaw shut in its closed position (not shown) for supporting a fiber optic terminus in fixture 15 during a polishing operation of the terminus. Optionally, additional guide elements such as pins 43 may be provided between top portion 31 and bottom portion 33 to hold them in alignment with respect to one another during a movement of jaw 35 between its open position and its closed position. It is noted that, although FIG. 4 shows in broken lines the threaded bore 29 corresponding to bolt 19, it has not been drawn to depict the bores for either bolts 39 or pins 43 for the sole purpose of maintaining clarity of the figure. The bores for bolts 39 and pins 43 are depicted in other figures that will be described in further detail below. The above notwithstanding, it is clear from FIGS. 3 and 4 that bolts 39 serve the dual functions of fastening top portion 31 and bottom portion 33 together and opening of jaw 35. Pins 43 may optionally be used to supplement the guiding function of bolts 39.

FIG. 3 shows a preferred embodiment of a fiber optic connector fixture assembly from its insertion side, that is, from the side at which a fiber optic connector is inserted into fixture 15 for being supported by the fixture during a polishing of the fiber optic terminus. For this purpose, a preferred embodiment of fixture 15 provides a terminus support profile 44, which, in the illustrated and preferred form, is a v-groove and counterbore structure. More particularly, the terminus support 44 includes a v-groove 45 framed by a counterbore having a first semicircular profile 47*a* in top portion 31 of fixture 15, and a complementary second semicircular profile 47*b* in bottom portion 33 of the fixture such that, in the closed position of jaw 35, profiles 47*a* and 47*b* contribute to substantially define the counterbore, that is, a bore framing v-groove 45 substantially at a center region thereof. In a closed position of the jaw about a fiber optic connector, the terminus 3 of the connector (see FIG. 1) is received in v-groove 45, and the counterbore frames the flange portion 9 of the connector 10 for securely supporting the terminus within fixture 15 during a polishing of terminus 3. A function of the counterbore is to provide an abutment surface for the connector of a fiber optic assembly and to allow the terminus thereof to emerge from the polishing face of the fixture. Profiles 47*a* and 47*b* preferably have a diameter that is large enough to accommodate most connector sizes and types without contacting the same, such as, for example a diameter of about 0.50 inch. The v-groove preferably has a depth between about 0.03 and 0.06 inch. It is to be noted that the above-mentioned dimensions are merely exemplary, the counter-bore and v-groove being dimensioned according to the present invention to accommodate connectors of varying sizes and types on the market. A further account of the insertion of the connector within fixture 15 will be given below.

Referring still to FIG. 3, interface arm 13 in the illustrated and preferred form of the present invention is configured for connection to the polishing arm of a FIBRMET® Portable Fiber Optic Polisher manufactured by the Buehler Company. It is noted however that the present invention includes within its ambit the configuration of an interface arm or adaptor and/or connection of the same with different types of polishing machines. In the illustrated form, interface arm 13 has a cylindrical polishing arm connection portion 49 and a fixture connection portion 51 that serves as a reference plate for the adjustment of fixture 15. Polishing arm connection portion 49 is adapted for direct connection with a fiber optic polisher. Fixture connection portion 51 is adapted for connection with fixture 15 by way of the aforedescribed preload mechanism 17 including the combination of bolt 19 and compression spring 25. Manifestly, additional bores 55 may be provided in the fixture connection portion 51 for connection and/or cooperation with rollers of the FIBRMET® polishing machine. Recesses 56 are preferably provided for reducing the weight of the arm.

As further seen in FIGS. 3 and 4, fixture assembly 12 further comprises a three point adjustment system according to one form of the present invention including a set of adjustment elements B, F and T received in corresponding bores $B_{1a}$, $F_{1a}$ and $T_{1a}$ of the interface arm 13. Adjustment elements B, F and T extend through the above respective bores and rest against corresponding detents in the bottom portion of the fixture 15, as seen more clearly in FIGS. 5 and 6*a*. As seen in FIGS. 3 and 6*a*, in the shown preferred embodiment of the invention, adjustment elements B, F and T are disposed such that the axes BF and FT define an angle of 90 degrees therebetween.

Figure 6C:
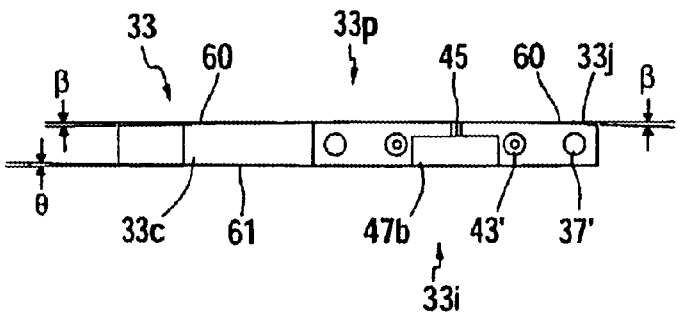
FIG. 6*c* is a top plan view of the bottom portion shown in FIG. 5.
Figure 6B:
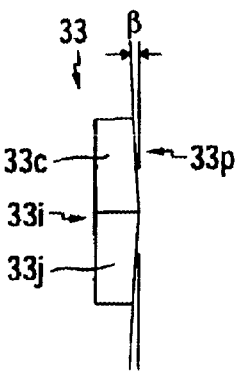
FIG. 6*b* is a first side elevational view of the bottom portion shown in FIG. 6*a* as seen from the right side of the bottom portion.
Figure 6A:
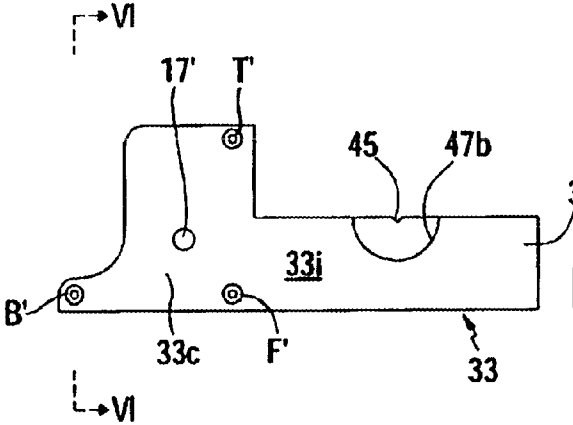
FIG. 6*a* is a front elevational view of the bottom portion shown in FIG. 5.
Figure 6D:
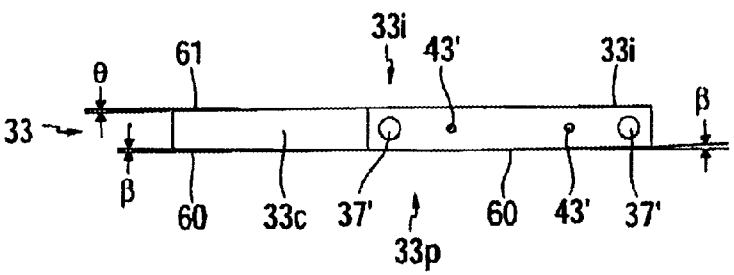
FIG. 6*d* is a bottom plan view of the bottom portion shown in FIG. 5.
Figure 6F:
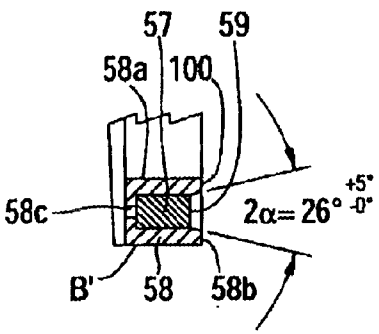
FIG. 6*f* is a view of detail f of FIG. 6*f;*
Figure 6E:
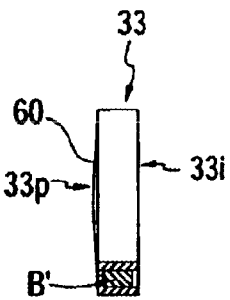
FIG. 6*e* is a second side elevational view of the bottom portion shown in FIG. 5 as seen from the left side of the bottom portion, showing a partial cross section through line VI—VI.
Figure 6G:
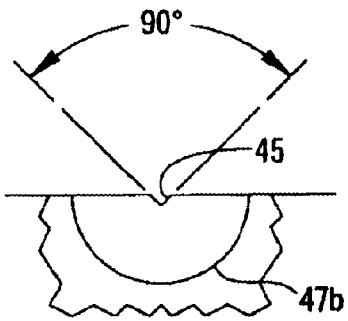
FIG. 6*g* is a view of detail g of FIG. 6*a;*

Turning now to FIGS. 5 and 6*a* through 6*g*, the bottom portion 33 of fixture 15 is shown in more detail. As seen in those figures, bottom portion 33 defines, as previously described, a terminus support profile 44 in the form of v-groove 45 together with second semicircular profile 47*b* of the counterbore. As seen in FIG. 6*g*, the v-groove preferably defines an angle of 90 degrees. An angle of 90 degrees for the v-groove is advantageous is that is provides an effective and secure profile for supporting a terminus. In addition, bores 37' and 43' are provided for receiving, respectively, threaded body portions 37 of bolts 39 and pins 43. As best seen in FIGS. 5, 6*a*–6*d*, bottom portion 33 of fixture 15 comprises a jaw portion 33*j* that defines the terminus support profile 44, and an interface arm connection portion 33*c* that is configured for connection to the fixture connection portion 51 of interface arm 13. Interface arm connection portion 33*c* has an internally threaded bore 17' adapted to receive the threaded body 23 of bolt 19 of the preload mechanism 17.

Connection portion 33*c* includes detents B', T' and F' against which adjustment elements B, F and T respectively bear in an assembled state of the fixture assembly 12, as can be seen in FIG. 4 for vertically offset elements F and T. Detents B', T' and F' present depressions in connection portion 33*c* such that they respectively register with bores $B_{1a}$, $F_{1a}$ and $T_{1a}$ of the interface arm 13 in an assembled state of the fixture assembly 12. Each detent provides a reference surface against which a corresponding adjustment element B, T or F may be adjusted for pivoting fixture 15 with respect to interface arm 13, as will be described in further detail below. By way of example and not limitation, the distance between F and B and the distance between F and T can be about 1 inch.

FIG. 6*e* shows a cross-section through a preferred form of a detent according to the present invention. FIG. 6*f* is a detailed or larger depiction of the detent of FIG. 6*e*. Although the above cross section is through detent B' along lines VI—VI in FIG. 6*a*, it is to be understood that the cross-section could be through any of the detents B', F' or T' according to a preferred embodiment of the present invention. Thus, while the description below refers to detent B only, it equally pertains to all of the detents B, F and T.

As seen in FIGS. 6*e* and 6*f*, the detent B' comprises a plug 57 disposed in a detent bore 58 defined in the connection portion 33*c* of fixture 15. The bore preferably includes a plug receiving surface portion 58*a* that is cylindrical, and a flared front recess 58*b* that defines an angle α with respect to a centerline of the cylindrical plug receiving portion. The recess 58*b* opens to the surface 33*i* of the fixture portion 33 facing the fixture connection portion 51 of the interface arm 13.

The angle α preferably measures about 13 degrees. Bore 58 further preferably defines a centrally extending aft portion 58*c* that is smaller in diameter than the plug receiving portion. Plug 57 itself has a flat front surface 59 recessed back from the surface 100 so that the adjustment element B can centered on the bore 58, and in particular recess portion 58*b* thereof so that its distal end engages against the plug surface 59 thereof. In this manner, plug 57 provides a rigid supporting surface 59 against which adjustment element B bears so that actuation of the element B causes precision adjustment of the fixture 15 with respect to interface arm 13. For this reason, the plug 57 is preferably made of a wear resistant material such as, for example, carbide. Flared front recess 58*b* accommodates a pivoting of the bottom end of adjustment element B during a pivoting adjustment of fixture 15 with respect to interface arm 13. In addition, aft portion 58*c* provides an escape through-hole for air existing within bore 58 prior to the bore being filled with the plug material.

Referring now to FIGS. 6*b* to 6*e*, various views of an insertion face 33*i* and of a polishing face 33*p* of bottom portion 33 are shown. The insertion face is provided at the insertion side of the fixture, which, as previously noted, is the side of the fixture at which a fiber optic connector is inserted into fixture 15 for being supported by the fixture during a polishing of the fiber optic terminus. As seen in FIGS. 6*b* to 6*e*, according to a preferred embodiment of the present invention, the polishing face 33*p* of bottom portion 33 of the fixture, that is, the face of bottom portion 33 facing a polishing surface during the polishing of a terminus placed in fixture 15, is beveled at an angle β. Preferably, polishing face 33*p* presents beveled surfaces 60 such that the location of the v-groove represents an apex for the beveled surfaces in two dimensions, that is, in a dimension defined by a top and bottom view of bottom portion 33 (see FIGS. 6*c* and 6*d*), and, in addition, in a dimension defined by side views of bottom portion 33 (see FIGS. 6*b* and 6*f*). In other words, the polishing face of bottom portion 33 is faceted away from the location for the insertion of the terminus in fixture 15. Preferably, the bevel angle β for surfaces 60 is about 2 degrees.

Additionally, as seen in FIGS. 6*c* and 6*d*, the insertion face of bottom portion 33 at connection portion 33*c* preferably has a beveled surface 61 that defines a bevel angle θ such that, in a top and bottom plan view as seen in FIGS. 6*c* and 6*d*, connection portion 33*c* defines a tapered profile extending away from v-groove 45. Beveled surfaces 60 allow the fixture to be pivoted with respect to a polishing surface without contact occurring between the insertion face 33*i* and the polishing surface. Additionally, beveled surface 61 allows a pivoting of the fixture 15 with respect to interface arm 13 without connection portion 33*c* contacting inner surface 22 of the interface arm (see FIG. 4) in its pivoting range.

Figure 7B:
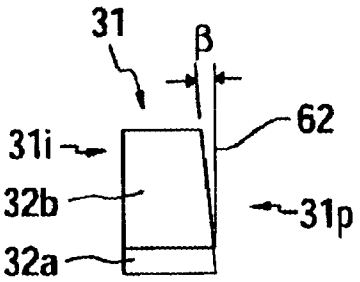
FIG. 7*b* is a first side elevational view of the top portion shown in FIG. 7*a* as seen from the right side of the top portion.
Figure 7A:
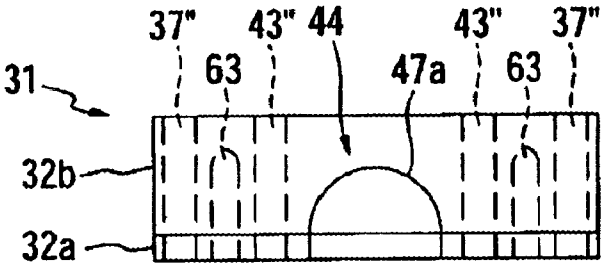
FIG. 7*a* is a front elevational view of the top portion of the fixture of the assembly shown in FIG. 3.
Figure 7C:
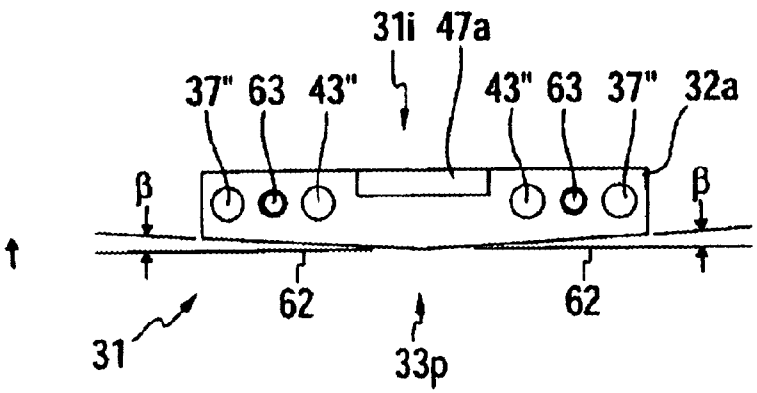
FIG. 7*c* is a bottom plan view of the top portion shown in FIG. 7*a;*

Turning now to FIGS. 7*a* to 7*c*, various views of top portion 31 of fixture 15 are provided according to a preferred embodiment of the present invention. Top portion 31 defines, as previously described, a terminus support profile 44 in the form of first semicircular profile 47*a* of the counterbore. In addition, bores 37" and 43" are provided for receiving, respectively, threaded body portions 37 of bolts 39 and pins 43. Additionally, top portion 31 defines bores 63 therein adapted to receive connecting elements such as bolts for connecting soft jaw portion 32*a* and rigid jaw portion 32*b* to one another. Similar to bottom portion 33, as seen more particularly in FIGS. 7*b* and 7*c*, according to a preferred embodiment of the present invention, the polishing face 31*p* of top portion 31 of the fixture is beveled. Preferably, polishing face 31*p* presents beveled surfaces 62 such that the location of the centerline for the semicircular profile 47*a* represents an apex for the beveled surfaces in two dimensions, that is, in a dimension defined by a bottom view of top portion 31 (see FIG. 7*c*), and, in addition, in a dimension defined by a side view of top portion 31 (see FIG. 7*b*). Preferably, the bevel angle β for surfaces 62 is about 2 degrees. It is therefore clear that, in the shown embodiment, fixture 15 has a polishing face that is faceted away from a location at which the terminus is adapted to emerge from the terminus support profile 44.

Figure 8C:
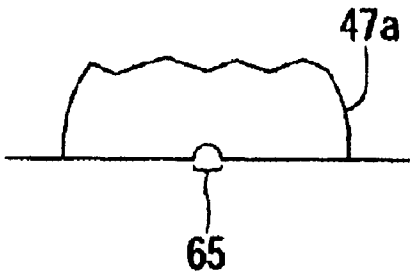
FIG. 8*c* is a front elevational view of the counterbore and protrusion of the soft jaw portion shown in FIG. 8*a*.
Figure 8A:
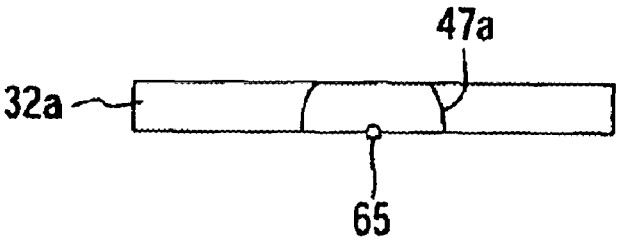
FIG. 8*a* is a front elevational view of an alternative embodiment for a soft jaw portion of the fixture according to the present invention.
Figure 8B:
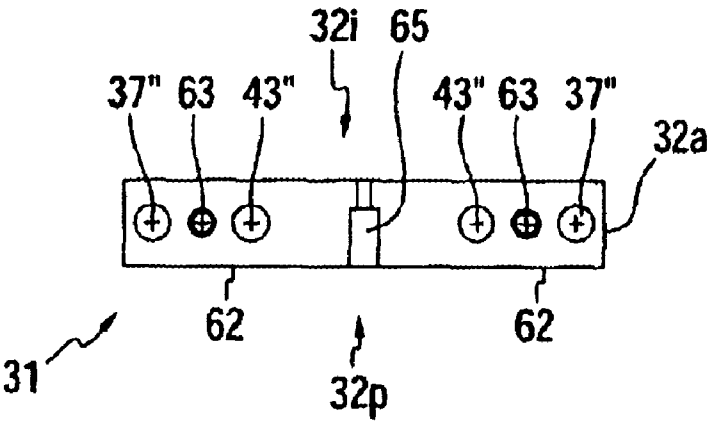
FIG. 8*b* is a bottom plan view of the soft jaw portion of FIG. 8*b*.

Referring now to FIGS. 8*a*, 8*b* and 8*c*, an alternative embodiment of soft jaw portion 32*a* is shown. Here, the soft jaw portion defines a protrusion 65 at a bottom center region thereof, protrusion 65 being framed at each side thereof by either half of semicircular profile 47*a*. Protrusion 65 preferably extends transversely from the insertion face 32*i* to the polishing face 32*p* of soft jaw portion 32*a*, as seen in FIG. 8*b*. Advantageously, the provision of a protrusion such as protrusion 65 in soft-jaw portion 32*a* allows the insertion of termini having diameters smaller than those that would be accommodated in v-groove 45 as depicted in FIG. 3, where no protrusion has been provided. The protrusion is adapted to register with the v-groove in a closed position of jaw 35 for clamping the terminus thereunder. Although no beveled surfaces have been shown in FIG. 8*b* on either the protrusion face or the insertion face of soft jaw portion 32*a*, it is understood that such beveled surfaces may be provided similar to surfaces 62 shown with respect to FIG. 7*c*.

The operation of the polishing fixture 15, and of the polishing fixture assembly 12 will now be described below.

In operation, and referring to the fixture assembly of FIG. 3, interface arm 13 is connected to the polishing arm of a FIBRMET® or other corresponding conventional polishing machine and secured thereto. In this way, jaw 35 is placed with the polishing sides 31*p* and 33*p* of its top and bottom portions facing a polishing disk. Thereafter, a fiber optic terminus of a fiber optic cable, such as, for example, terminus 3 of cable C shown in FIG. 1, is placed in jaw 35 when the jaw is in its open position as depicted in FIG. 3. Specifically, the terminus is placed in v-groove 45, and bolts 39 tightened to place jaw 35 in its closed position, thereby clamping the terminus between top portion 31 and bottom portion 33 of jaw 35, the soft-jaw 32*a* advantageously minimizing scratching or cracking of the terminus. The closing of the jaw approaches profiles 47*a* and 47*b* toward one another such that they together contribute to define a counterbore within which the outer sleeve of a fiber optic connector, such as, for example, flange 9 of connector C shown in FIG. 1, is accommodated. The counterbore defined by profiles 47*a* and 47*b* has a large enough diameter such that it does not contact the sleeve of the fiber optic connector, but allows the same to advance within the jaw to allow the terminus to protrude out from the polishing side thereof by a desired maximum amount P, which is typically about 50/1000 inch. It is noted that a contacting of the sleeve of the connector by the walls of the counterbore would disadvantageously tend to compromise the secure support of the terminus within the v-groove among other things by misaligning the terminus in the v-groove, and thus by compromising a precision securing of the terminus in the fixture, to the extent that the terminus is a precision component providing a reliable reference element, and that the connector is not such a component. After a closing of the jaw, the terminus will have been positioned to face the polishing surface, the next step then involving an adjustment of fixture 15 with respect to interface arm 13 in order to substantially eliminate any apex offset of the terminus with respect to the polishing surface.

According to a preferred method of adjusting the fixture 15 with respect to interface arm 13, and hence with respect to the polishing surface, as an initial step, adjustment elements B, F and T are moved into their reference positions. In other words, B, F and T are actuated into respective predetermined positions that serve as respective references for a further actuation of the adjustment elements. Preferably, where B, F and T are screws, they are turned in such that their bottom ends bottom-out or enter into contact with their respective detents B', F' and T' while the inner surface 22 of interface arm 13 remains in contact with the insertion face of connection portion 33*c* of jaw 35. Thereafter, B, F and T are all actuated by a predetermined amount so that they create a reference gap between inner surface 22 of interface arm 13 and the insertion face of connection portion 33*c*, the reference gap allowing an a range of pivoting of fixture 15 with respect to interface arm 13. In addition to the gap, the beveling of the insertion side of connection portion 33*c* of the fixture by an angle θ widens the angular pivoting range of the fixture with respect to the interface arm by providing greater clearance between the arm and the side edge of connection portion 33*c* so as to substantially limit it from contacting inner surface 22 of interface arm 13 during the pivoting of the fixture with respect thereto. Where B, F and T are screws, they are turned by the predetermined amount to create the above-mentioned reference gap, e.g. 0.05 inches. The above steps result in adjustment elements B, F and T having been set in their reference positions. Preferably, the compliant preload 17 is loosened prior to the actuation of the adjustment elements for the creation of the reference gap as by turning the bolt 19 in the loosening direction by approximately three turns. Loosening the compliant preload allows the fixture to be pivoted through its full pivot range with respect to the interface arm while ensuring a biased connection between the two components.

For an adjustment of the fixture with respect to the polishing surface, B and/or T are actuated until substantial orthogonality is established between the terminus and the polishing surface, the adjustment being effected in the manner described with respect to FIGS. 2*a* through 2*c* above. Where interferometry is to be used, the terminus is first polished when B, F and T are in their reference positions. The polished terminus is then viewed using an interferometer, and the degree of apex offset, preferably in both the x and y directions, is measured in a conventional manner. Thereafter, F is kept fixed, and B and T are actuated to move the fixture in a manner that will result in an equal and opposite vector that cancels out the machine misalignment. Any vector can be decomposed into "x" and "y" components. Therefore, one adjustment element is designed to move the fixture in a "x" direction, the other in a "y" direction. The pattern or relative location of the adjustment elements, coupled with the pivoting nature of the design, produces mutually orthogonal movements of the fixture. Where the adjustment elements are screws, one turn produces a fixed amount of fixture movement (typically 10–100 microns) depending on parameters such as screw threads per inch, screw spacing, radius, etc. Thus, the "x" and "y" screws are adjusted in or out some fraction of a turn depending on the magnitude and direction of the required correction vector. The third screw, which acts a reference pin and a pivot, is not adjusted. After apex offset is adjusted as noted above, the compliant preload 17 is preferably tightened for securely fastening the fixture to the interface arm, and the terminus is polished again and placed in the interferometer to check for any residual apex offset misalignment. Usually, the apex offset is within specifications. If not, the adjustment step is repeated until the interferometer indicates a substantial elimination of apex offset.

In the alternative, a laser reflection method or an alignment puck may be used as described above to adjust apex offset, adjustment elements B and T being actuated until the desired orientation of the fixture with respect to the polishing surface is established as previously described.

The provision of a wear resistant plug, such as plug 57 (see FIGS. 6*e* and 6*f*) in detents B', F' and T'allows adjustment elements B and T to press against the rigid support surface 59 of the plug substantially without deforming the detent material, thus ensuring a reliable adjustment of apex offset over repeated adjustment operations. In addition, the flared front recess 58*b* of the detent allows a pivoting of the ends of the adjustment elements within the detents during a corresponding pivoting of the fixture with respect to the inner surface 22 of the interface arm. Thus, the fixture assembly 12 according to a preferred form of the invention can include features that accommodate a pivoting of the fixture with respect to the interface arm and/or with respect to the polishing surface, these features including an angling of the insertion face of connection portion 33*c* with respect to the inner surface 22 of interface arm 13, a faceting away of the polishing face of jaw 35 from the location for the insertion of a terminus in fixture 15, and a provision of a flared front portion 59*b* defining a tapering recess for the movement of the ends of the adjustment elements therein during a pivoting of the fixture 15 with respect to the interface arm 13.

Advantages of the present invention over the prior art are many, and some of them have already been mentioned above. The present invention advantageously enables obsolete polishing machines to meet today's apex offset standards and performance requirements, thus allowing a recouping of capital equipment costs. It allows apex offset adjustment on-site, resulting in improvements in fiber optic cable assembly product performance, reliability, repeatability, quality and yield. A reduction in manufacturing costs and time are additional benefits due to fewer scrapped parts and few re-polishing efforts. It offers a simple apex offset adjustment method that allows the user the flexibility of compensating for process variables introduced by typical polishing changes or upgrades without the need for complex factory-only alignment equipment and procedures, and without the need for shimming. Additionally, according to a preferred embodiment of the invention, the provision of a fixture having a terminus support profile defining a v-groove and a counterbore as seen in FIG. 3 advantageously allows the fixture to be used for connectors of different sizes and types.

The present invention further pertains to a fiber optic polishing fixture assembly for supporting a terminus of a fiber optic cable before a polishing surface, the assembly comprising: a fiber optic polishing fixture defining a terminus support profile for supporting the terminus before the polishing surface; a fixture support connected to the fixture for supporting the fixture before the polishing surface; and means for changing a distance between the fixture and the fixture support at least two point locations for effecting a pivoting adjustment about a third point location of the fixture with respect to the fixture support for substantially eliminating an apex offset of the terminus with respect to the polishing surface. The means for changing has been substantially described in relation to FIGS. 2*a* through 8*c* above. An example of the means for changing includes the set of adjustment elements B, F and T previously described.

It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A fiber optic connector polishing fixture assembly for supporting a terminus of a fiber optic cable before a polishing surface, the assembly comprising:

a fiber optic polishing fixture adapted to support the terminus before the polishing surface wherein the fixture comprises a jaw movable between an open position and a closed position for securely clamping the terminus therein during a polishing thereof by the polishing surface;

a fixture support connected to the fixture for supporting the fixture before the polishing surface;

a top portion corresponding to a top portion of the jaw and a bottom portion slidably connected to the top portion, wherein the fixture has a terminus support profile including:

a v-groove defined in the bottom portion of the fixture and adapted to receive the terminus therein;

a first semicircular recess defined in the top portion;

a second semicircular recess defined in the bottom portion such that, in a closed position of the jaw the first semicircular recess and the second semicircular recess are joined to define a counterbore framing the v-groove substantially at a center region thereof; and, an adjustable connection between the fixture and the fixture support having user accessible adjustment controls for allowing a user to operate the controls to shift the fixture and fixture support relative to one another for substantially eliminating an apex offset of the terminus with respect to the polishing surface.

2. A fiber optic connector polishing fixture assembly for supporting a terminus of a fiber optic cable before a polishing surface, the assembly comprising:

a fiber optic polishing fixture adapted to support the terminus before the polishing surface;

a fixture support connected to the fixture for supporting the fixture before the polishing surface; and, an adjustable connection between the fixture and the fixture support having user accessible adjustment controls for allowing a user to overate the controls to shift the fixture and fixture support relative to one another for substantially eliminating an apex offset of the terminus with respect to the polishing surface wherein the adjustable connection comprises a set of three elements including a first adjustment element, a second adjustment element and a third adjustment element, the adjustment elements being disposed with respect to one another such that, in a cross-sectional plane through the adjustment elements substantially parallel to the fixture support, points corresponding to respective centerlines of the three adjustment elements are not aligned;

wherein:

the first adjustment element is actuatable for effecting a change in the distance between the fixture support at a location of the first adjustment element; and the second adjustment element is actuatable for effecting a change in the distance between the fixture and the fixture support at a location of the second adjustment element, an actuation of at least one of the first adjustment element and the second adjustment element effecting a pivoting adjustment of the fixture support for substantially eliminating an apex offset of the terminus with respect to the polishing surface.

3. The assembly according to claim 2, wherein, in the cross sectional plane substantially parallel to the fixture support, a line through points corresponding to respective centerlines of the first adjustment element and the third adjustment defines an axis i, and a line through points corresponding to respective centerlines of the second adjustment element and the third adjustment element defines an axis ii, axes P and ii defining an angle gamma about 90 degrees therebetween.

4. The assembly according to claim 1, wherein the fixture support comprises an interface arm connected to a polishing machine.

5. The assembly according to claim 1, wherein the fixture support comprises a support structure for the polishing surface.

6. The assembly according to claim 2, wherein each of the first adjustment element and the second adjustment element comprises a screw, an actuation of either of the first adjustment element and the second adjustment element being effected by a turning of a corresponding screw corresponding thereto.

7. The assembly according to claim 2, wherein the third adjustment element is configured to remain fixed during an actuation of at least one of the first adjustment element and the second adjustment element thereby serving as a pivot point for pivoting the adjustment of the fixture with respect to the fixture support for substantially eliminating an apex offset of the terminus with respect to the polishing surface.

8. The assembly according to claim 7, wherein the third adjustment element comprises one of a screw, a ball joint and a fixed rod.

9. The assembly according to claim 1, further comprising a compliant preload mechanism for connecting the fixture and the fixture support to one another, the compliant preload being effective for biasing the fixture and the fixture support toward one another during a shifting of the fixture and fixture support relative to one another, and further being effective for securely fastening the fixture and the fixture support to one another after the shifting of the fixture and fixture support relative to one another for substantially eliminating an apex offset of the terminus with respect to the polishing surface.

10. The assembly according to claim 9, wherein the compliant preload mechanism comprises:

a preload bolt having a head and a threaded body and threaded through corresponding bores in the fixture and in the fixture support; and a compression spring resting at one end thereof against an inner face of the head of the preload bolt and at another end thereof against an outer surface of the fixture support.

11. The assembly according to claim 1, wherein the counterbore has a diameter of about 0.50 inch and the v-groove has a depth between about 0.03 inch and 0.06 inch.

12. The assembly according to claim 2, wherein a distance between the third adjustment element and each of the first adjustment element and the second adjustment element is about 1 inch.

13. The assembly according to claim 1, wherein the top portion comprises soft jaw portion and a rigid jaw portion connected to the soft jaw portion, the soft jaw portion being adapted to contact the terminus in a dosed position of the jaw and being made of a material that is more compliant and more wearable than that of the rigid jaw portion for substantially preventing a scratching and cracking of the terminus when the terminus is supported in the jaw.

14. The assembly according to claim 13, wherein the soft jaw portion is of a machinable polytetrafluoroethylene-based material.

15. The assembly according to claim 1, wherein the fixture and the fixture support are of stainless steel.

16. The assembly according to claim 4, wherein the bottom portion comprises a jaw portion and a connection portion integral with the jaw portion, the jaw portion defining the v-groove and second semicircular profile therein and the connection portion being connected to the interface arm.

17. The assembly according to claim 16, wherein:

the adjustable connection comprises a set of three adjustment elements including a first adjustment element, a second adjustment element, and a third adjustment element, the adjustment elements being disposed with respect to one another such that, in a cross-sectional plane through the adjustment elements substantially parallel to the fixture support, points corresponding to respective centerlines of the three adjustment elements are not aligned;

wherein:

the first adjustment element is actuatable for effecting a change in the distance between the fixture and the fixture support at a location of the first adjustment element; and the second adjustment element is actuatable for effecting a change in the distance between the fixture and the fixture support at a location of the second adjustment element, an actuation of at least one of the first adjustment element and the second adjustment element effecting a pivoting adjustment of the fixture with respect to the fixture support for substantially eliminating an apex offset of the terminus with respect to the polishing surface; and the connection portion has a set of three detents therein adapted to abut against bottom ends of respective ones of the three adjustment elements for providing respective reference surfaces for a pivoting adjustment of the fixture with respect to the fixture support through an actuation of at least one of the first adjustment element and the second adjustment element.

18. The assembly according to claim 17, wherein each of the three detents defines a detent bore and includes a plug disposed in the detent bore, the plug having a rigid supporting surface that is adapted to abut against a respective bottom end of a corresponding adjustment element.

19. The assembly according to claim 18, wherein the plug is of carbide.

20. The assembly according to claim 17, wherein each of the three detents further comprises a flared front recess adapted to receive therein a respective bottom end of a corresponding adjustment element, the flared front recess being effective for accommodating a pivoting of the respective bottom end during a pivoting adjustment of apex offset.

21. The assembly according to claim 18, wherein each of the three detents further comprises an aft portion providing an escape through-hole for air during a filling of a corresponding detent bore with a material for the plug.

22. The assembly according to claim 1, wherein a polishing face of the fixture is faceted away from a location at which the terminus is adapted to emerge from the terminus support profile, the polishing face thereby defining beveled surfaces.

23. The assembly according to claim 22, wherein a bevel angle beta of the beveled surfaces of the polishing face of the fixture is about 2 degrees.

24. The assembly according to claim 16, wherein the connection portion of the bottom portion of the fixture presents a beveled surface extending away with respect to a facing inner surface of the interface arm.

25. The assembly according to claim 24, wherein a bevel angle theta of the beveled surface of the connection portion is about 2 degrees.

26. The assembly according to claim 13, wherein the soft jaw portion defines a protrusion at a middle region thereof adapted to register with the v-groove when the jaw is in its closed position for securely clamping a terminus thereunder.

27. A fiber optic connector polishing fixture assembly for supporting a terminus of a fiber optic cable before a polishing surface, the assembly comprising:

a fiber optic polishing fixture adapted to support the terminus before the polishing surface;

a fixture support connected to the fixture for supporting the fixture before the polishing surface;

an adjustable connection between the fixture and the fixture support having user accessible adjustment controls for allowing a user to operate the controls to shift the fixture and fixture support relative to one another for substantially eliminating an apex offset of the terminus with respect to the polishing surface; and, a compliant preload mechanism for connecting the fixture and the fixture support to one another, the compliant preload being effective for biasing the fixture and the fixture support toward one another during a shifting of the fixture and fixture support relative to one another, and further being effective for securely fastening the fixture and the fixture support to one another after the shifting of the fixture and fixture support relative to one another for substantially eliminating an apex offset of the terminus with respect to the polishing surface.

28. The assembly according to claim 27, wherein the compliant preload mechanism comprises;

a preload bolt having a head and a threaded body and threaded through corresponding bores in the fixture and in the fixture support; and, a compression spring resting at one end thereof against an inner face of the head of the preload bolt and at another end thereof against an outer surface of the fixture support.

* * * * *